United States Patent [19]

Hubbs

[11] 4,050,174

[45] Sept. 27, 1977

[54] REVOLVER GUN

[75] Inventor: Robert J. Hubbs, Riverside, N.J.

[73] Assignee: The Raymond Lee Organization, Inc., New York, N.Y. ; a part interest

[21] Appl. No.: 706,208

[22] Filed: July 19, 1976

[51] Int. Cl.[2] ..... F41C 1/00

[52] U.S. Cl. ..... 42/59; 89/155

[58] Field of Search ..... 42/59; 89/155

[56] References Cited

U.S. PATENT DOCUMENTS

| | | | |
|---|---|---|---|
| 726,109 | 4/1903 | Stow | 89/155 |
| 1,972,763 | 9/1934 | Dutton | 89/155 |
| 3,055,270 | 9/1962 | Miller | 42/59 |

FOREIGN PATENT DOCUMENTS

| | | | |
|---|---|---|---|
| 114,184 | 10/1900 | Germany | 89/155 |

*Primary Examiner*—Charles T. Jordan

[57] ABSTRACT

A revolver pistol which ejects the spent cartridge after each shot. The gun block is fitted with an open side port. The recoil of the cartridge during firing drives back the hammer and breechblock, with the cartridge ejecting through the open port. The breechblock is spring-biased to return forwards and index the revolver cylinder on the forward stroke, with the hammer remaining in the rear position until released by the trigger mechanism.

2 Claims, 4 Drawing Figures

REVOLVER GUN

SUMMARY OF THE INVENTION

My invention is a revolver pistol which ejects the spent cartridge after each shot.

The gun block is fitted with an open side port.

The recoil of the cartridge during firing drives back the hammer and breechblock, with the cartridge ejecting through the open port.

The bleechclock is spring-biased to return forwards and index the revolver cylinder on the forward stroke, with the hammer remaining in the rear position until released by the trigger mechanism.

By means of my invention a revolver gun may automatically eject each spent cartridge as it is fired to reduce the reloading time of an empty revolver.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
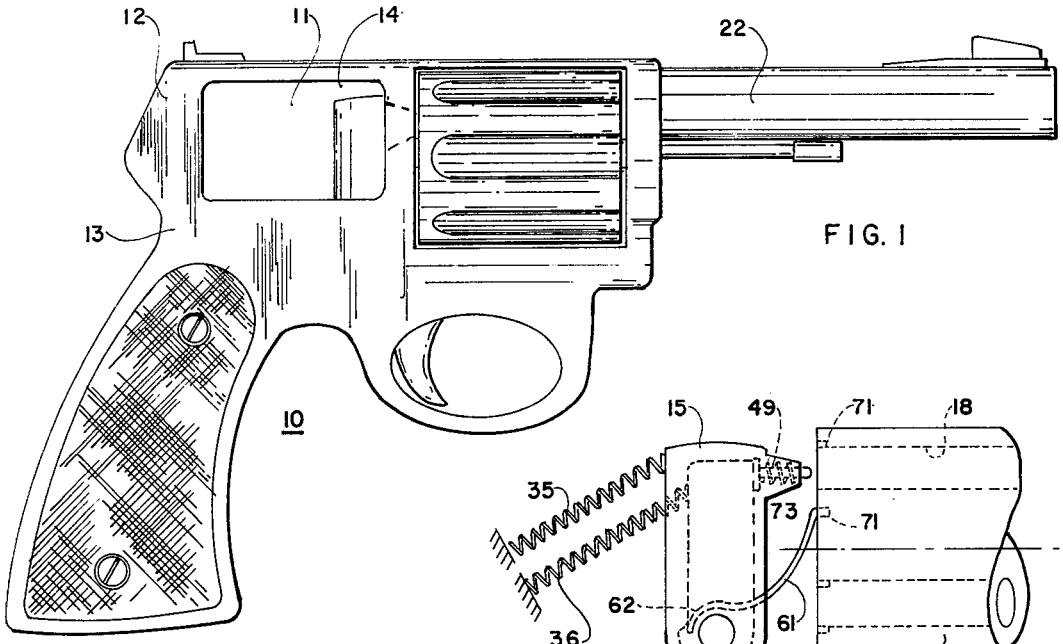
FIG. 1 is a side view of the invention.
Figure 2:
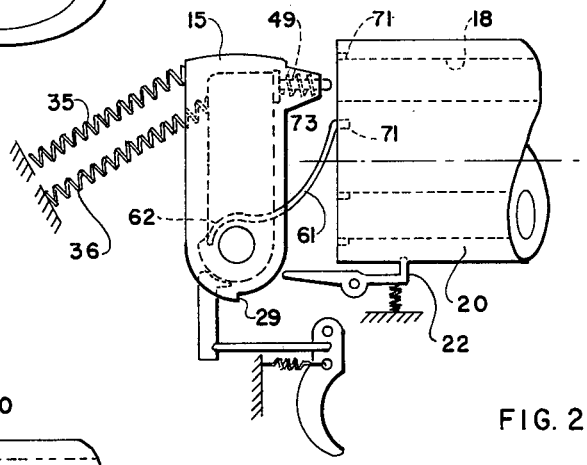
FIG. 2 is a detail side view of the revolver mechanism, immediately upon firing of a first round.

Turning now descriptively to the drawings, in which similar reference characters denote similar elements throughout the several views, FIG. 1 illustrates the revolver gun 10 of the invention. An open port 11 is frmed on one side 12 of the gun block 13 leading to an interior chamber 14 housing the breechblock 15 and hammer 16 are joined to the rear of the cartridge chamber 18 of the revolver cylinder 20 that is in the firing position, aligned with gun barrel 22.

Revolver cylinder 20 is held is fixed position by a cylinder lock bar 22 pivotably mounted about pin 23 mounted to the gun block 13 and biased by spring 24 to latch detent 25 on the front end of lock bar 22 in engagement with a recess 26 in revolver cylinder 20.

Breechblock 15 is fitted about a recessed hammer 16 both individually pivotably mounted about pivot pin 31 which is fixed to gun block 13. Spring 35 biases breechblock 15 to the forward position with spring 36 biasing hammer 16 to the forward position.

An inertia firing pin 32 biased by spring 49 is slidably mounted on breechblock 15, and located to strike the center of the head 37 of a cartridge 38 in revolver chamber 18 when struck by hammer 16.

Figure 3:
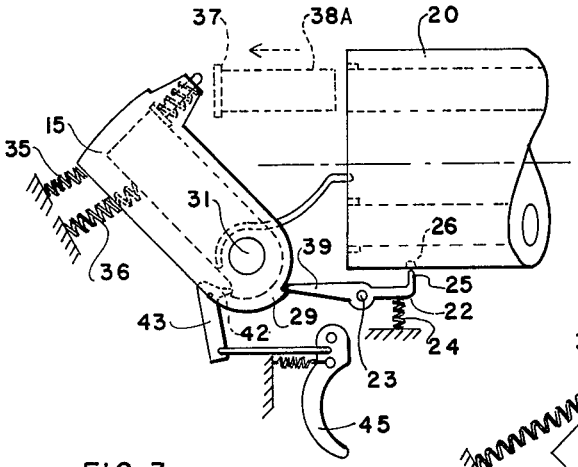
FIG. 3 is a detail view of the revolver mechanism, immediately after firing of a first round.

A cam detent 29 is located on breechblock 15 so as to engage the rear end 39 of lock bar 22 to rotate lock bar detent 25 out of engagement with revolver cylinder recess 26 when breechblock 15 is rotated to the rear position show in FIG. 3 by the recoil action of a fired cartridge 38A that is rearwardly ejected by firing recoil backwards out of chamber 18 immediately after being fired.

Figure 4:
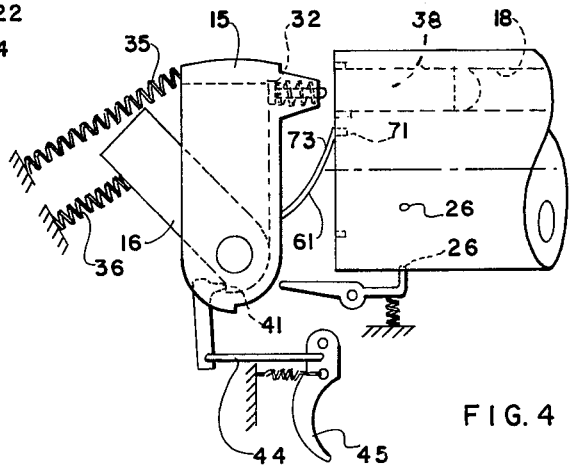
FIG. 4 is detail view of the revolver mechanism subsequent to firing of a round, with the hammer cocked for firing of a second round.

Hammer 16 is fitted with a cam detent 41 engaged by detent 42 of a pivotally mounted sear 43 linked by rod 44 to the pivotably mounted trigger 45, with sear detent 42 retaining hammer 15 in the cocked rearwards position shown in FIGS. 3–4, after firing, until trigger 45 is pulled. The trigger-sear linkage also preferably includes a disconnector (not shown) that requires the user to relax pressure on the trigger between two subsequent firings of the gun.

A cylinder indexing hand 61 is pivotably mounted to the breechblock 15 extending to a rachet recess 71 on the revolver cylinder 20, with the toothed end 73 of hand 61 engaging recess 71 to rotate cylinder 20 on the return forward stroke of breechblock 15 to align a fresh cartridge chamber in the revolver cylinder with the gun barrel 22, preparatory to firing by the release of trigger 45 and hammer 16.

Breechblock 15 and hammer 16, upon the firing of a cartridge recoil to the rearward position, with the spent cartridge 38A recoiling freely through gun port 11. The breechblock then returns to the forward position while the hammer remains cocked in the rearward position until released by the trigger to strike the firing pin.

Since obvious changes may be made in the specific embodiment of the invention described herein, such modifications being within the spirit and scope of the invention claims, it is indicated that all matter contained herein is intended as illustrative and not as limiting in scope.

Having thus described the invention, what I claim as new and desire to secure by Letters Patent of the United States is:

1. A revolver gun which ejects each spent cartridge immediately upon being fired, comprising a gun fitted with a revolver cylinder fitted with chambers for holding cartridges, first spring-biased means to latch the revolver cylinder in a fixed position, second means to rotate the revolver cylinder, said first means linked to a breechblock pivotably mounted in said gun so as to release said latch when the breechblock is in a recoil position.

said second means linked to the breechblock so as to rotate the revolver cylinder when the breechblock returns from the recoil position to a firing position, said breechblock pivotably mounted and spring-biased to remain in the firing position except under the recoil forces of a fired cartridge in the revolver cylinder, which fired cartridge serves to rotate the breechblock to the recoil position while the fired cartridge is ejected out of the revolver cylinder.

2. The combination as recited in claim 1 in which an open port is provided in the gun to permit a recoiled cartridge to freely fall out of the gun.

* * * * *